US010076924B2

(12) United States Patent
Jameson et al.

(10) Patent No.: US 10,076,924 B2
(45) Date of Patent: Sep. 18, 2018

(54) SLIDE IN DIVIDERS

(71) Applicant: CCL Label, Inc., Framingham, MA (US)

(72) Inventors: Alan Jameson, West Covina, CA (US); Regina Reichert, Whittier, CA (US); Jay Sato, Mission Viejo, CA (US); Eric Cushing, Riverside, CA (US)

(73) Assignee: CCL Label, Inc., Framingham, MA (US)

( * ) Notice: Subject to any disclaimer, the term of this patent is extended or adjusted under 35 U.S.C. 154(b) by 18 days.

(21) Appl. No.: 15/151,763

(22) Filed: May 11, 2016

(65) Prior Publication Data

US 2016/0332478 A1 Nov. 17, 2016

Related U.S. Application Data

(60) Provisional application No. 62/159,455, filed on May 11, 2015.

(51) Int. Cl.
*B42F 21/06* (2006.01)

(52) U.S. Cl.
CPC ..... *B42F 21/06* (2013.01)

(58) Field of Classification Search
CPC ..... B42F 21/06; B42F 1/02
USPC ..... 402/79; 116/238, 239; 24/67.3, 67.9; D19/34
See application file for complete search history.

(56) References Cited

U.S. PATENT DOCUMENTS

| | | | | |
|---|---|---|---|---|
| D211,924 | S * | 8/1968 | Margeson | D19/34 |
| 5,398,384 | A * | 3/1995 | Rinard | B42F 1/06 24/67.9 |
| 5,597,256 | A * | 1/1997 | Burton | B42F 11/00 402/79 |
| 6,015,166 | A * | 1/2000 | May | B42D 9/005 281/42 |
| 2003/0223804 | A1* | 12/2003 | Roca | B42F 3/003 402/79 |
| 2009/0311037 | A1* | 12/2009 | Leung | B42D 13/00 402/79 |

* cited by examiner

*Primary Examiner* — Kyle Robert Grabowski
(74) *Attorney, Agent, or Firm* — McDonald Hopkins LLC

(57) ABSTRACT

A divider assembly is shown and described herein. The divider assembly may divide a stack of sheets, the divider assembly may include a body and a tab extending from the body. The divider may include at least one arm extending from the body and defining an elongated slot with the body that is configured for connecting to a binder. Further, at least one protrusion may be configured to selectively abut against bindings of the binder to selectively attached the divider thereon.

15 Claims, 6 Drawing Sheets

SLIDE IN DIVIDERS

CROSS-REFERENCE TO RELATED APPLICATION

This application claims the benefit from Provisional Patent Application No. 62/159,455 titled "SLIDE IN DIVIDERS" filed on May 11, 2015 which is hereby incorporated by reference in its entirety.

FIELD OF INVENTION

The present disclosure generally relates to an apparatus for organizing and indexing documents wherein the apparatus includes a divider or tabbed dividers that are usable with a variety of bound documents. More particularly, the disclosure relates to embodiments of dividers compatible with documents bound with ring or wire bindings.

BACKGROUND

Dividers for organizing sheets of paper or display elements can include tabs that extend beyond the perimeter of the paper. The tabs may include label indicia thereon to identify the divided section of the sheets of paper or display elements. Known tabs may be formed out of generally clear or transparent material and formed into pockets to insert a label having indicia thereon. Other known dividers have tabs made of clear or transparent material that include labels that may be attached by a pressure sensitive adhesive directly to the tab.

Dividers are often utilized in binders such as three ring binders or spiral binders and other types of folders or media assemblies. The dividers separate and visually label various sections of the sheets of paper or display elements to permit prompt access to any one of these sections.

However, the known divider systems have inherent deficiencies as there may be a limited available location for the dividers. Further, different dividers may be needed for differently sized three ring binders, spiral note books, papers, and the like. Therefore, there is a need for increased adjustability and versatility associated with dividers to allow for greater customization and user satisfaction. There is also a need for an improved divider system that increases the usability of tabbed dividers.

SUMMARY

A divider system is shown and described herein. The divider system may include a divider assembly for dividing a stack of sheets. A divider assembly may include a tab extending from an edge of a body of the divider assembly. At least one arm may extend from the body and define an elongated slot with the body that is configured for connecting to a document binding system. At least one protrusion may be configured to selectively abut against bindings of the document binding system to retain the divider assembly thereon.

The at least one protrusion may extend from the arm towards the body of the divider or may extend from the body towards the arm. There may be at least one protrusion or a plurality of protrusions. In one embodiment there are at least four protrusions. Further, the arm may extends from a side of the body wherein the arm having a length that may be less than a length of the side of the body. Alternatively, the arm length may be greater than a length of the side of the body. In one embodiment, the at least one protrusion is a clasp and extends from the body. Alternatively, the at least one protrusion may have a tapered profile and extend from the body.

The divider may be inserted and attached to a binder. The binder may be a ringed binder having a set of rings to which the stack of sheets and the divider may attach. The divider may attach to the binder at any appropriate edge of the divider, such as the first edge, the second edge, or the third edge. A position of the tab may be altered based on which of the arms are utilized for connection of the divider to the binder. The divider may be made of a rigid or semi-rigid material, such as a plastic material. The rigidity of the material may prevent the divider from accidently disengaging from the bindings.

In another embodiment, the divider assembly may include a first arm that extends from a first side of the body and a second arm that extends from a second side of the body, wherein the tab of the divider assembly may be selectively configured to at least partially extend passed a top portion of pages within the binder when the first arm is attached to the bindings of the binder, and wherein the tab of the divider is selectively configured to at least partially extend passed a side portion of the pages within the binder when the second arm is attached to the bindings of the binder.

The following description and the drawings set forth certain illustrative aspects of the specification. The drawings indicate a few of various embodiments that may utilize certain aspects of this disclosure. While some improvements and novel aspects may be specifically identified, others will be apparent from the detailed description.

DESCRIPTION OF THE DRAWINGS

The accompanying drawings illustrate various systems, apparatuses, devices and methods, in which like reference characters refer to like parts throughout, and in which.

DETAILED DESCRIPTION

Figure 1A:
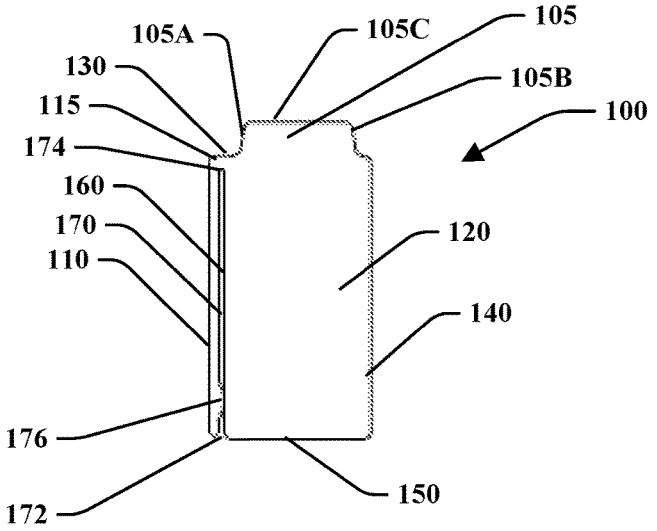
FIG. 1A is a front view of a divider in accordance an embodiment of the present disclosure.

Reference will now be made in detail to embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

As used herein, the term "tab" may refer to an element that may extend from an edge of a divider. Such elements may be of various shapes. The shapes may be generally rectangular, generally elliptical, generally triangular, irregular in shape, and the like. Accordingly, it is noted that embodiments referencing a tab are not limited by a particular type or design of the tab. As such, it is noted that appropriate modifications may be made based on a desired tab. Tabs herein are designed to extend passed an edge of sheets of paper that are arranged within a notebook or binder.

Further, unless context suggest otherwise, descriptions of shapes (e.g., circular, rectangular, triangular, etc.) refer to shapes meeting the definition of such shapes and general representation of such shapes. For instance, a triangular shape or generally triangular shape may include a shape that has three sides and three vertices or a shape that generally represents a triangle, such as a shape having three major sides that may or may not have straight edges, triangular like shapes with rounded vertices, and the like.

It is noted that while various embodiments refer to a divider or a divider assembly, various other assemblies may be utilized in the scope and spirit of embodiments described herein. As such, references to dividers and the like are understood to include various assemblies that may be inserted into a binder. Such assemblies may include, but are not limited to, folders, cover sheets, pouches (e.g., pencil cases, etc.), sleeves (e.g., plastic sleeves to which papers or other materials may be inserted), and the like. Furthermore, while dividers are described as organizing notebooks, spiral notebooks, binders, three ring binders, or the like, it is noted that the described divider assemblies may be applied to organize or otherwise affect location and placement of materials in various other objects or devices. For instance, dividers of this disclosure may be utilized in such items as a spiral note book, filing cabinet, ROLODEX, pronged folders, N-ring binders (where N is a number), index card boxes, and the like.

Divider assemblies of this disclosure may be of any appropriate configuration and are not limited to those shown and described herein. It should be noted that the divider systems may be adapted to divide a plurality of sheets or other display elements of any appropriate size, including, without limitation, 8.5 inches by 11 inches, A4 size, legal size or any other applicable size. Furthermore, the divider systems may be configured to be utilized with a binder of any appropriate size and construction.

It is noted that the various embodiments described herein may include other components and/or functionality. However, some components or functionality that may be apparent may not be explicitly described for the sake of brevity. Such components and functionality are considered within the scope and spirit of the various embodiments described herein.

Aspects of devices described herein generally relate to a divider device. In one embodiment, the divider device may include a divider body including first, second, third, and fourth sides. The various sides may include one or more tabs that extend from the divider body. At least one arm extends from the divider body, a portion of the arm is spaced from the body forming a slot. The slot may be configured to receive bindings from a notebook or binder to position the divider in place on the binder such that at least a portion of a tab extends from a periphery of at least one sheet within the binder. The divider may be configured to be attached in a desired position of the tab and/or orientation of the divider.

In an example, a user may select a desired position of a tab relative to a spiral bound binder having materials (e.g., paper) retained thereon. The user may then select an appropriate configuration of the divider assembly for connection to bindings of the binder. Once connected, the placement of the tab at least partially extends past the perimeter/periphery of the bound materials such as paper. Further, a plurality of divider assemblies described herein may be positioned in an overlapping or sequential manner. For example, a user may have several dividers and/or tabs aligned in a single binder.

Figure 1B:
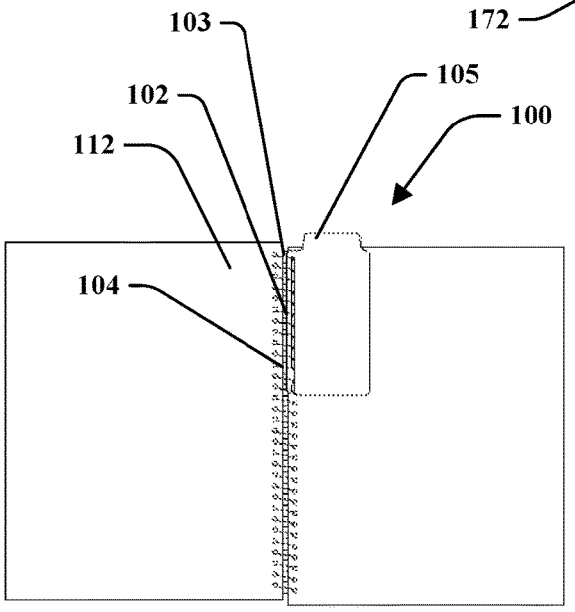
FIG. 1B is a front view of the divider of FIG. 1A attached to a notebook in an open position in accordance with various described embodiments.
Figure 1C:
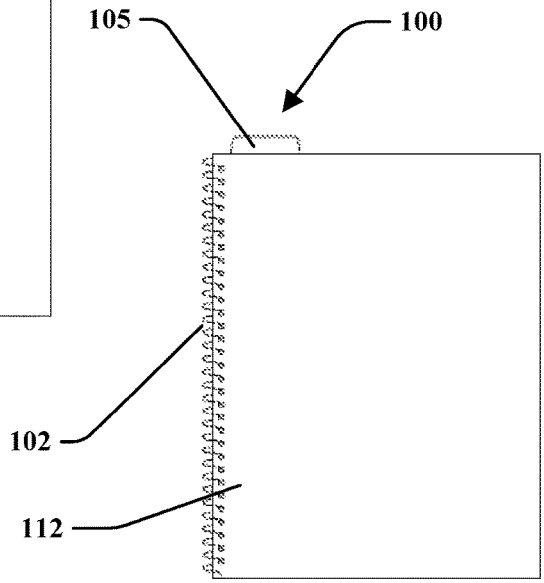
FIG. 1C is a front view of the divider of FIG. 1A with the notebook in a closed position in accordance with various described embodiments.

FIGS. 1A, 1B and 1C illustrate a front view of a divider assembly 100 in accordance the present disclosure. Divider 100 may be inserted or attached to a binder 112 that attaches paper by a binding 102 such as spiral bound documents, an N-ring binder, a notebook or the like. For instance, in one embodiment, the bindings 102 (such as a wire or ring) may be shaped in an orientation to secure materials such as paper in a desired order within the binder 112. The divider 100 may include a body portion 120 having a perimeter. In one embodiment, the perimeter may be defined by a first side 130, a second side 140, a third side 150 and a fourth side 160. However, the body portion 120 may include any number of sides and this disclosure is not limited. Further, the divider 100 may include at least one tab 105 outwardly extending from the perimeter of the body portion 120. In this embodiment, the tab 105 may positioned along the first side 130 of the divider 100.

The tab 105 may have a width that is defined by a first edge 105A and an opposite second edge 105B. The width of the tab 105 may be less than a width of the body portion 120 defined by the second side 140 and the fourth side 160. The tab 105 may also include a top edge 105C that extends between the first edge 105A and the second edge 105B. The top edge 105C may be generally parallel with the first side 130 of the body portion 120. Further, the first edge 105A and the second edge 105B may have a generally tapered orientation. In particular, the first edge 105A may extend from the first side 130 of the body portion at an angle tapered towards the second edge 105B while the second edge 105B may extend from the first side 130 of the body portion 120 at an angle tapered towards the first edge 105A. The first edge 105A and second edge 105B may intersect with the top edge 105C and include generally rounded corners. However, the shape and orientation of the tab 105 relative to the body portion 120 is not limited as the tab 105 may be configured to extend passed a periphery of the paper sheets organized within the binder while an arm 110 and body portion 120 are attached thereto.

In one or more embodiments, divider 100 may be made of any appropriate material, including, without limitation a plastic or polymer material (e.g., a polypropylene material, acrylics, etc.), paper products (e.g., cardboard, coated or uncoated paper), leather, metal, fabric (e.g., felt) a composite material, or the like. In many embodiments, divider 100 is made of a material having a greater thickness, stiffness, and/or durability than typical paper sheets. Divider 100 may include clear or opaque, colored or colorless, transparent, translucent or semi-translucent material and include various combinations of the above aspects. In one non-limiting embodiment, the divider 100 may be formed from a monolithic piece. Divider 100 may at least partially include translucent or semi-translucent materials. Further, divider 100 may include printed and/or monolithically formed ornamental designs (e.g., floral patterns, geometric patterns, etc.), indicia, measuring markings (e.g., such as ruler markings), printed information (e.g., charts, graphs, product information, etc.), and the like.

The tab 105 may have a generally monolithic continuous configuration with the body portion 120 of the divider 100 and may be formed on the divider 100 by a die-cutting machine, mold, or other cutting apparatus generally known in the art. In other embodiments, the tab 105 may be of a separate construct that is attached (e.g., removably or irremovably) to divider 100 by an adhesive or other method. The tab 105 made of any appropriate material, including, without limitation, paper products (coated or un-coated), a polymer material such as a polypropylene material, fabric, metal, leather, and the like. The tab 105 may be clear or opaque, colored or colorless, transparent, translucent or semi-translucent material and include various combinations of colors or printed information/designs. The tab 105 may be a flat or substantially flat configuration or may comprise tactile indicia (e.g., Braille). In at least one embodiment, the tab 105 may comprise a pocket or slot that may receive an insert or label. Furthermore, the tab 105 may be configured for receiving an adhesive label, writing (e.g., ink, led, graphite, etc.).

The divider 100 may also include at least one arm 110 that extends from the body portion 120. The arm 110 may comprise various configurations that generally forms an elongated slot 170 with a side of the body portion 120. As illustrated by FIG. 1A, the arm 110 may form the slot 170 with the fourth side 160 of the body portion. The arm 110 may be configured to be selectively attached to the bindings 102 of the binder 112. The arm 110 may extend from a shoulder 115 of the body portion 120 such that the elongated slot 170 includes and open distal portion 172 and an opposite inner apex portion 174 adjacent to the shoulder 115 of the body portion 120. The binding 102 of the binder 112 may abut against the inner apex portion 174 of the elongated slot 170 when the divider 100 is attached to the binder 112. Further, a protrusion 176 may be located along the arm 110 and may extend towards the body portion 120 of the divider 100. The protrusion 176 may be configured to abut against the fourth side 160 of the body portion 120. In one embodiment, the protrusion 176 may have a generally semi-circular profile. However, the shape and location of the protrusion may have various different embodiments and profiles and this disclosure is not limiting. The protrusion 176 may be positioned along the arm 110 to correspond to a location of a binding 102 (spiral wire or ring) relative to the inner apex portion 174. This would allow at least one of the bindings 102 of the binder 112 to be received within the elongated slot 170 such that a first binding 103 abuts against the inner apex portion 174 near the shoulder 115 of the divider 100 and a second binding 104 abuts against the protrusion 176 along the arm 110. In one embodiment, the arm 110, inner apex portion 174 and protrusion 176 are configured to be capable of selectively locking the divider 100 to the bindings 102 of the binder 112 such that at least a portion of the tab 105 extends passed a periphery of the materials (i.e. paper) bound by the binder 112. Additionally, at least a portion of the tab 105 may extend passed a periphery of the binder 112.

To selectively attach the divider 110, a user may bias the arm 110 relative to the body portion 120 thereby creating at least a slight space between the protrusion 174 and the perimeter of the body 120 to allow the bindings 102 to be received within the elongated slot 170.

Figure 2A:
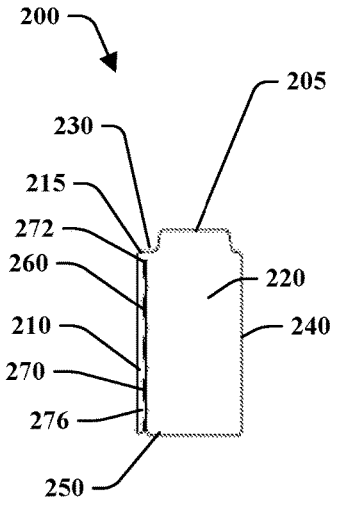
FIG. 2A is a front view of a divider in accordance with an embodiment of the present disclosure.
Figure 2B:
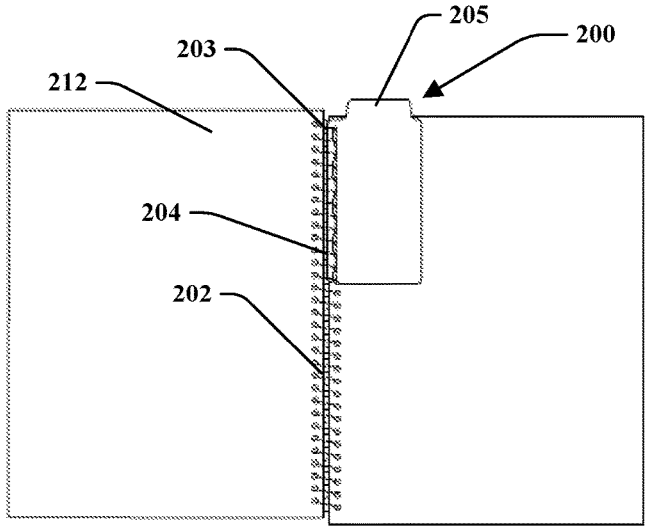
FIG. 2B is a front view of the divider of FIG. 2A attached to a notebook in an open position in accordance with various described embodiments.

Moreover, various embodiments of the divider are contemplated by this disclosure. These embodiments allow a user to selectively attach the divider assembly to the binder without having to open the binding mechanism for insertion, removal. In this regard, the divider may have various geometrical arrangements that allow a particular divider to be adaptable to a particular binder. For example, FIGS. 2A, and 2B illustrate a front view of a divider 200 in accordance with one embodiment of the present disclosure. Divider 200 may be inserted or attached to a binder 212 such as spiral bound documents, an N-ring binder, a notebook or the like. For instance, in one embodiment, a binding 202 may be shaped in a orientation to secure materials such as paper in a desired order within the binder 212. The divider 200 may include a body portion 220 having a perimeter. In one embodiment, the perimeter may be defined by a first side 230, a second side 240, a third side 250 and a fourth side 260. However, the body portion 220 may include any number of sides and this disclosure is not limited. Further, the divider 200 may include at least one tab 205 outwardly extending from the perimeter of the body portion 220. In this embodiment, the tab 205 may be positioned along the first side 230 of the divider 200.

The divider 200 may also include at least one arm 210 that extends from the body portion 220. The arm 210 may comprise various configurations that may generally form an elongated slot 270 with a side of the body portion 220. As illustrated by FIG. 2A, the arm 210 may form the slot 270 with the fourth side 260 of the body portion 220. The arm 210 may be configured to be selectively attached to the bindings 202 of the binder 212. The arm 210 may extend from a shoulder 215 of the body portion 220 such that the elongated slot 270 includes an open distal portion and an opposite inner apex portion 272 adjacent to the shoulder 215 of the body portion 220. The bindings 202 of the binder 212 may abut against the inner apex portion of the elongated slot 270 when the divider 200 is attached to the binder 212. Further, a plurality of protrusions 276 may be located along the arm 210. The protrusions 276 may extend towards the body portion 220 of the divider 200 and may be configured to abut against the fourth side 260. In one embodiment, the protrusions 276 may have a generally semi-circular profile but the shape of the protrusion may have various different profiles and this disclosure is not limiting. In this embodiment, four protrusions 276 are disclosed but any number may be utilized and this disclosure is not limited. The protrusions 276 may be positioned along the arm to correspond to the locations of a plurality of the spaced bindings 202 (spiral wire or ring) relative to the inner apex portion. This would allow a plurality of the bindings 202 of the binder 212 to be received within the elongated slot 270 such that a first binding 203 abuts against the inner apex portion near the shoulder 215 of the divider 200 and additional bindings 204 abut against the plurality of spaced protrusions 276 along the arm 210. In one embodiment, the arm 210, inner apex portion 274 and protrusions 276 are configured to be capable of selectively locking the divider 200 to the bindings 202 of the binder 212 such that at least a portion of the tab 205 extends passed a periphery of the materials (i.e. paper) to be bound by the binder 212. Additionally, at least a portion of the tab 205 may extend passed a periphery of the binder 212.

To selectively attach the divider 210, a user may bias the arm 210 relative to the body 220 thereby creating at least a slight space between the protrusions 274 and the body 220 to allow the bindings 202 to be received within the elongated slot 270.

Figure 3A:
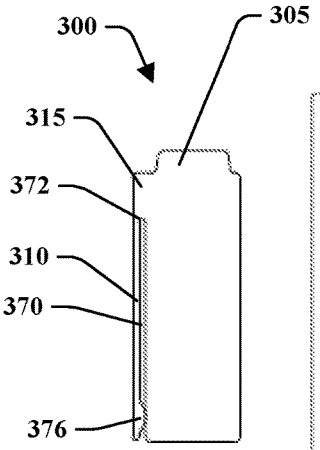
FIG. 3A is a front view of a divider in accordance with an embodiment of the present disclosure.
Figure 3B:
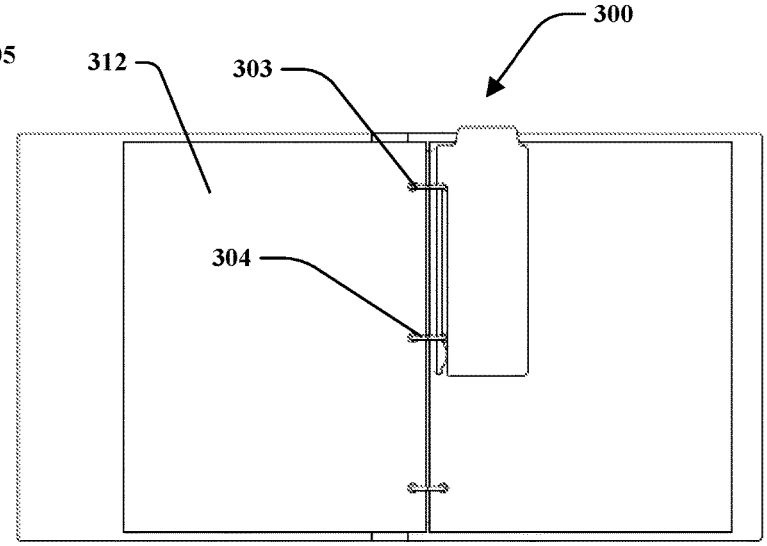
FIG. 3B is a front view of the divider of FIG. 3A attached to a notebook in an open position in accordance with various described embodiments.

The remaining embodiments to be described may have similar features to dividers 100 and 200 and will be described in accordance therewith. The various embodiments may have various shapes and numbers of arms and protrusions. The arms and protrusions of the dividers may comprise different shapes, sizes, positioning, and the likes. For instances, one divider 300 may have an arm 310 that extends from a shoulder 315 of the divider 300 that is generally spaced from a first side 330 to allow the divider 300 to selectively attach with a three ring binder as illustrated by FIGS. 3A and 3*b*. In this embodiment, the length of the arm extends from the first ring 303 and passed the second ring 304. The arm 310 forms an elongated slot 370 configured to receive the first and second rings 303, 304 thereon such that the first ring abuts an inner apex 372 and the second ring 304 abuts a protrusion 376. Here, the shoulder 315 has a greater length than shoulder 115 as the tab 305 is configured to extend passed a periphery of the paper and/or binder 312.

Figure 4:
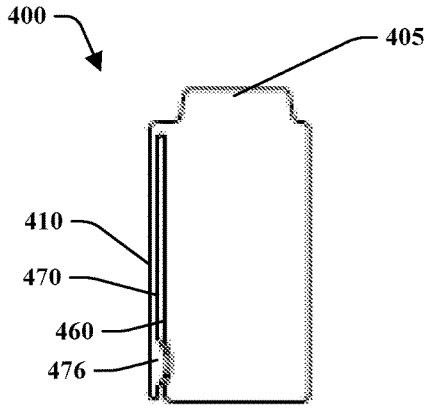
FIG. 4 is a front view of a divider in accordance with an embodiment of the present disclosure.

In a further embodiment, divider 400 as illustrated by FIG. 4, includes an arm 410 that extends from the divider body. The arm 410 may include a protrusion 476 that extends toward the side 460 of the body. The side 460 may be contoured to match the shape of the protrusion 476. The protrusion 476 may be biased away from the side 460 to create space to selectively receive the bindings within an elongated slot 470. Alternatively, the side 260 may be overlapped with the protrusion 476 such that the protrusion 476 may rest against a surface of the divider 400 and be biased away from the surface to create space to selectively receive the bindings within the elongated slot 470.

Figure 5A:
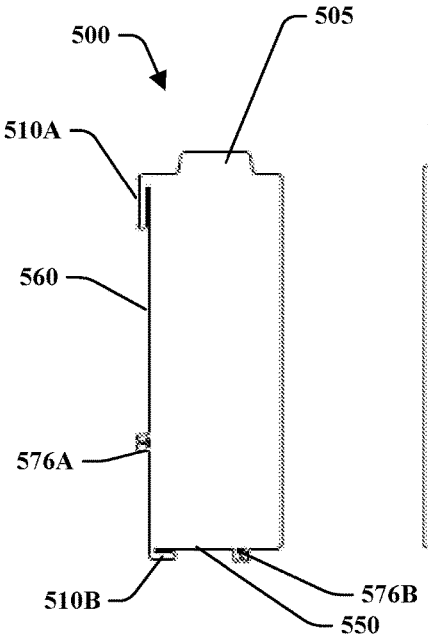
FIG. 5A is a front view of a divider in accordance with an embodiment of the present disclosure.
Figure 5B:
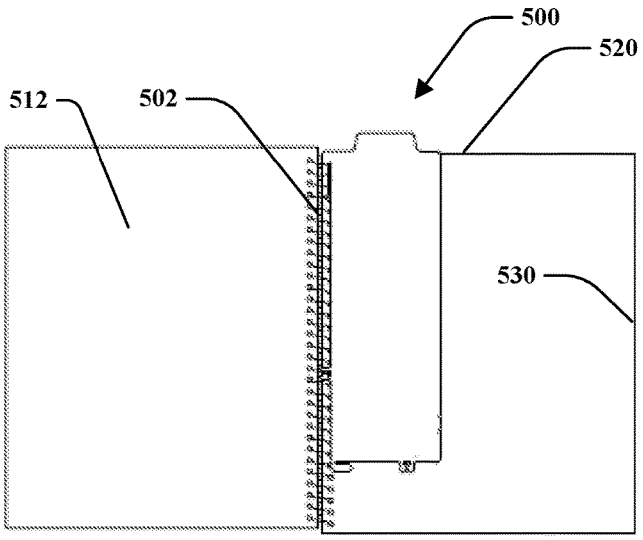
FIG. 5B is a front view of the divider of FIG. 5A attached to a notebook in an open position in accordance with various described embodiments.

As illustrated by FIGS. 5A and 5B, divider 500 includes a body having a generally rectangular shape wherein a first arm 510A extends from a first side 560 and a second arm 510B extends from a second side 550 wherein the first side 560 is longer than the second side 550. Additionally, a first protrusion 576A extends from the first side 560 and is spaced from the arm 510A and a second protrusion 576B extends from the second side 550 and is spaced from the second arm 510B. In this configuration, the divider 500 may be selectively attached to the bindings 502 such that at least a portion of the tab 505 may be aligned with and extend passed a top portion 520 of the binder 512 when the first arm 510A and first protrusion 576A are attached to the bindings 502. Additionally, the divider 500 may be selectively attached to the bindings 502 such that at least a portion of the tab 505 may be aligned with and extend passed a side portion 530 of the binder 512 when the second arm 510B and the second protrusion 576B are attached to the bindings 502. In this embodiment, the first and second protrusions 576A, 576B are configured in a shape of a clasp that may be selectively snap fit onto a ring or wire binding of the binder 512. Additionally, the first and second arms 510A, 510B have a length that is less than the lengths of the first and second sides 560, 550.

Figure 6B:
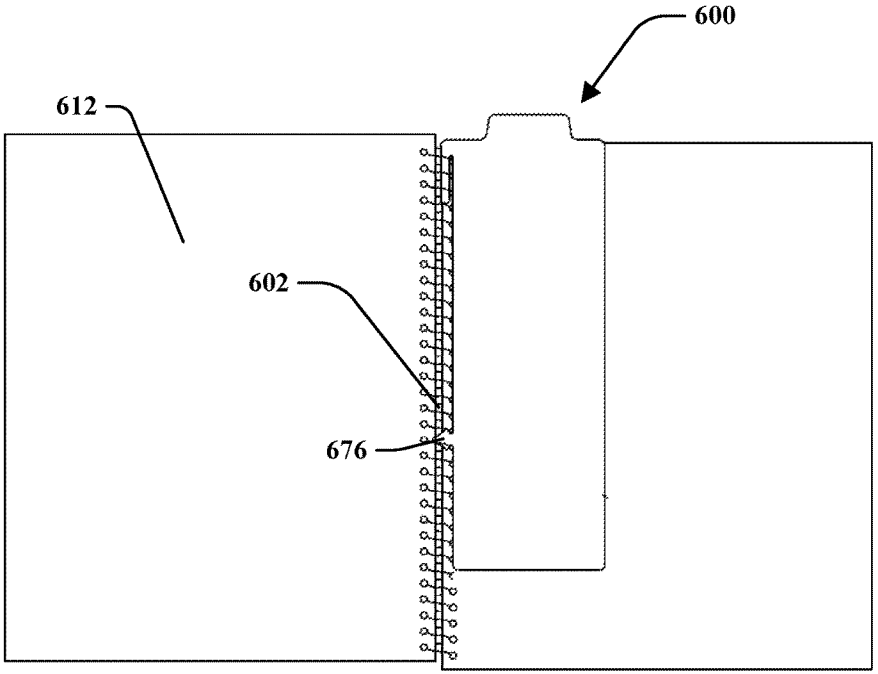
FIG. 6B is a front view of the divider of FIG. 6A attached to a notebook in an open position in accordance with various described embodiments.
Figure 6A:
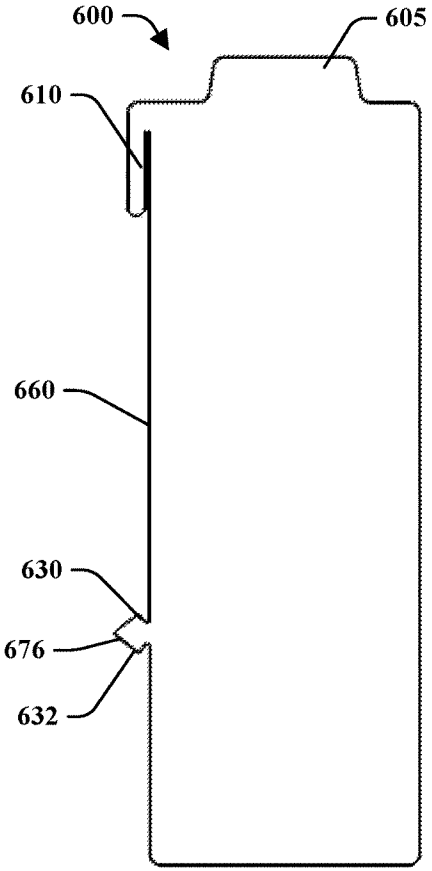
FIG. 6A is a front view of a divider in accordance with an embodiment of the present disclosure.
Figure 7:
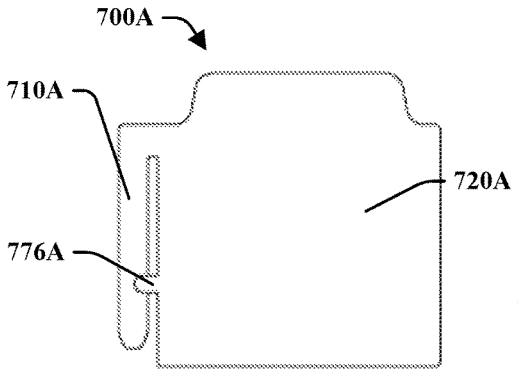
FIG. 7 is a front view of a divider in accordance with an embodiment of the present disclosure.
Figure 8:
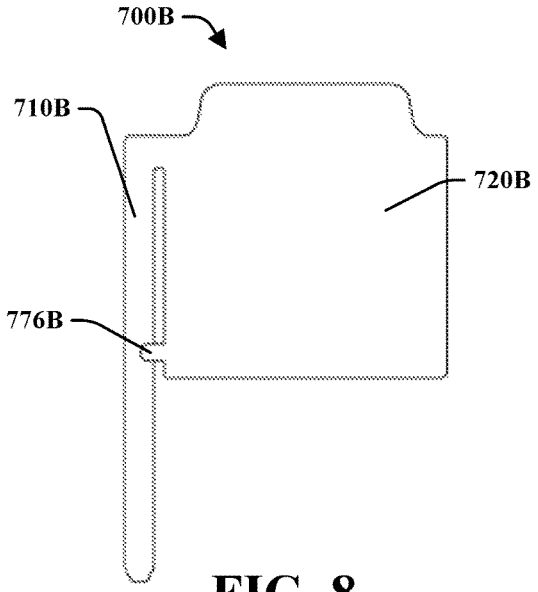
FIG. 8 is a front view of a divider in accordance with an embodiment of the present disclosure.
Figure 9:
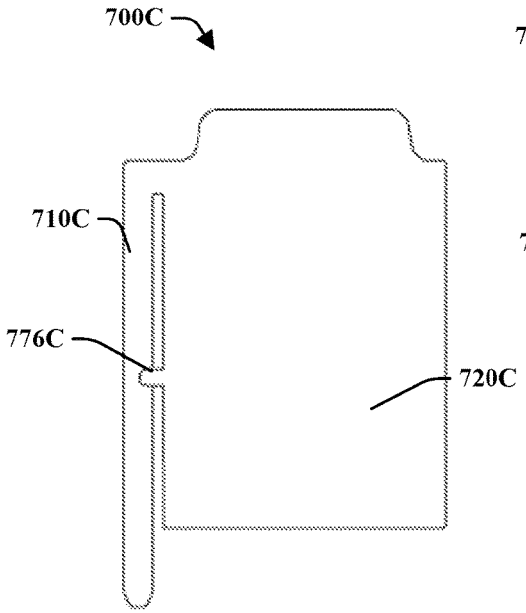
FIG. 9 is a front view of a divider in accordance with an embodiment of the present disclosure.
Figure 10:
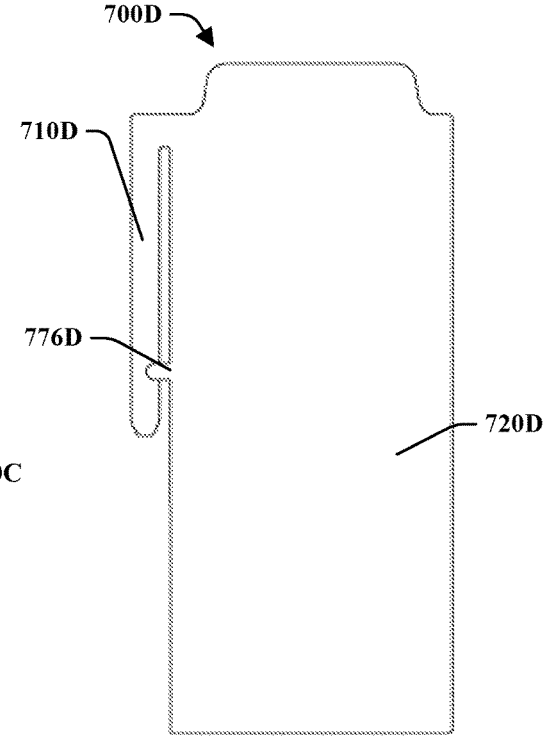
FIG. 10 is a front view of a divider in accordance with an embodiment of the present disclosure.

As illustrated by FIGS. 6A and 5B, divider 600 includes an arm 610 that extends from a first side 660 of a divider body and a protrusion 676 that extends from the first side 660 and is spaced from the arm 610. In this configuration, the divider 600 may be selectively attached to the bindings 602 of a divider 612 such that at least a portion of the tab 605 may be aligned with and extend passed a top portion of the binder 612 when the arm 610 and protrusion 676 are attached to the bindings 602. In this embodiment, the protrusion 676 may be configured in a general triangle shape of having a tapered profile such that opposing edges 630, 632 of the protrusion 676 extend passed adjacent bindings 602 to be selectively attached thereon. The adjacent bindings 602 may be spiral wire type and be biased away from one another to receive the tapered profile of the edges 630, 632 of the protrusion 676 therein. Additionally, the arm 610 includes a length that is less than the length of the first side 660.

Figure 11:
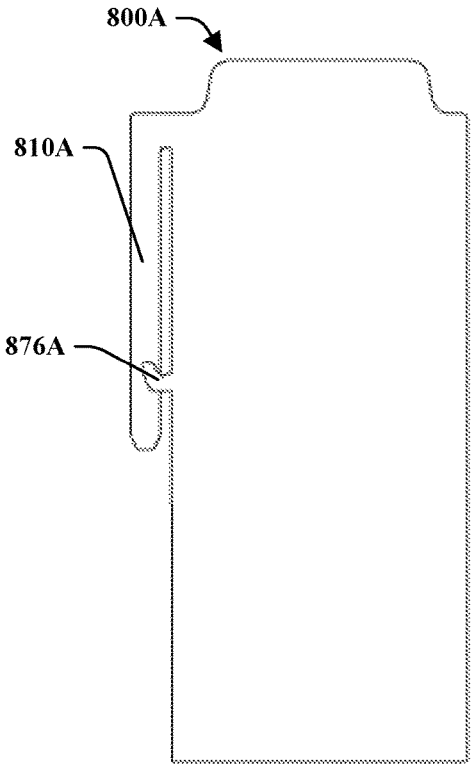
FIG. 11 is a front view of a divider in accordance with an embodiment of the present disclosure.
Figure 12:
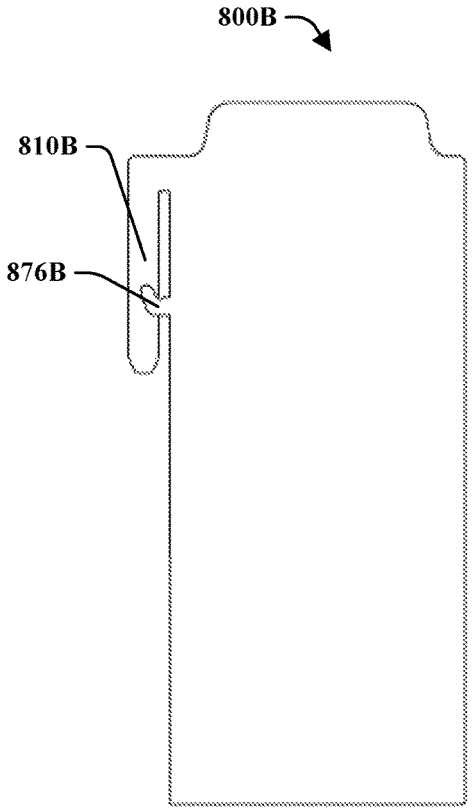
FIG. 12 is a front view of a divider in accordance with an embodiment of the present disclosure.

As illustrated by FIGS. 7-10, dividers 700A, 700B, 700C, 700D may have various configurations of divider bodies 720A, 720B, 720C, 720D, arms 710A, 710B, 710C, 710D and protrusions 776A, 776B, 776C, 776D. For example, the arms and bodies may have various lengths relative to one another. Further the protrusions may have various positions relative to the length of the arms and size of the bodies. In these embodiments, the protrusions may extend from the bodies and abut against a surface of the arm or vice versa. Alternatively, The sides of the bodies may be contoured to match the shape of the protrusions such that the protrusions may be biased away from the side to create space to selectively receive the bindings within the elongated slot. Further, as illustrated by FIGS. 11 and 12, protrusions 876A, 876B may extend from the bodies and have a generally hooked shaped profile. These configurations allow the arm to be biased relative to the protrusion to receive the bindings of the binder within the elongated slot. The position of the protrusion relative to the inner apex of the arm allows the divider to be selectively secured to the bindings of the binder.

In embodiments, one protrusion may have a different shape or profile than another protrusion located along the same divider. Furthermore, the protrusions may be generally circular, generally rectangular, a polygon, irregular in shape, or any other desired shape. Additionally, protrusions may be aligned along either the arm or the body, according to the spaces of the bindings of the binder. For example, the protrusions may be aligned such that a center or near center of the protrusions are aligned between individual spiral wires of the binder. It is noted that other alignments may be utilized based on a desired configuration. It is noted that other configurations may be utilized. For instance, one or more of the dividers having a plurality of arms and protrusions extending therefrom may be rotated and/or flipped such that a tab extends from a different side, such as described with reference to FIGS. 5A and 5B.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The features of each embodiment described and shown herein may be combined with the features of the other embodiments described herein. The claims as follows are intended to include all modifications and alterations insofar as they come within the scope of the claims or the equivalent thereof.

Having thus described the invention, we claim:

1. A divider assembly, the divider assembly comprising:

a tab extending from an edge of a body of the divider assembly;

at least one arm extending from the body and defining an elongated slot with the body that is configured for connecting to a binder system; and at least one protrusion that extends from the body towards the arm and abuts against a surface of the arm wherein the arm is selectively positionable against a biasing force relative to the body creating a space between the at least one protrusion and the arm to allow for receiving bindings of the binder system.

2. The divider assembly according to claim 1, wherein the arm extends from a side of the body, the arm having a length that is less than a length of the side of the body.

3. The divider assembly according to claim 1, wherein the arm extends from a side of the body, the arm having a length that is greater than a length of the side of the body.

4. The divider assembly according to claim 1, wherein the at least one protrusion is a clasp.

5. The divider assembly according to claim 1, wherein the at least one protrusion has a tapered profile.

6. The divider assembly according to claim 1, further comprising a first arm extending from a first side of the body, a second arm extending from a second side of the body, and a second tab of the divider assembly extending from a third side of the body.

7. A divider assembly, the divider assembly comprising:

a tab extending from an edge of a body of the divider assembly;

at least one arm extending from a shoulder of the body and defining an elongated slot with the body that is connectable with a binder system, the elongated slot includes an open distal portion and an opposite inner apex portion adjacent to the shoulder of the body; and at least one protrusion that extends from the body towards the arm and abuts against a surface of the arm, wherein the arm is selectively positionable against a biasing force relative to the body creating a space between the at least one protrusion and the arm to allow for receiving bindings of the binder system.

8. The divider assembly according to claim 7, wherein the arm extends from a side of the body, the arm having a length that is less than a length of the side of the body.

9. The divider assembly according to claim 7, wherein the arm extends from a side of the body, the arm having a length that is greater than a length of the side of the body.

10. The divider assembly according to claim 7, wherein the at least one protrusion is a clasp.

11. The divider assembly according to claim 7, wherein the at least one protrusion has a tapered profile.

12. The divider assembly according to claim 7, further comprising a first arm extending from a first side of the body, a second arm extending from a second side of the body, and a second tab of the divider assembly extending from a third side of the body.

13. A divider assembly for dividing a stack of sheets within a binder, the divider assembly comprising:

a tab extending from an edge of a body of the divider assembly;

at least one arm extending from a shoulder of the body and defining an elongated slot with the body that is connectable to bindings of the binder, the elongated slot includes an open distal portion and an opposite inner apex portion adjacent to the shoulder of the body; and at least one protrusion that extends from the body towards the arm to abut against a surface of the arm wherein the arm is selectively positionable against a biasing force relative to the body creating a space to allow for receiving the bindings of the binder, wherein the tab is selectively positioned to at least partially extend passed a top portion of a stack of sheets within the binder when the arm is attached to the bindings of the binder.

14. The divider assembly according to claim 13 wherein a first binding of the binder abuts against the inner apex portion near the shoulder of the divider assembly and a second binding abuts against the protrusion such that the arm, inner apex portion and protrusion selectively lock the divider assembly to the bindings of the binder.

15. A binder assembly comprising:

a binder comprising at least a pair of rings and front and rear covers;

a divider assembly comprising:

a body having an edge;

a tab extending from the edge of the body;

an arm extending from the body and defining an elongated slot with the body, wherein the at least the pair of rings is positioned in the slot; and at least one protrusion extending from the body towards the arm selectively abutting against the arm for holding the body in an operative position relative to the at one of the at least the pair of rings.

* * * * *